US005779430A

United States Patent [19]

Ball

[11] Patent Number: 5,779,430

[45] Date of Patent: Jul. 14, 1998

[54] MATERIAL HANDLING SYSTEM

[75] Inventor: E. Gary Ball, Millers Tavern, Va.

[73] Assignee: Rockland, Inc., Bedford, Pa.

[21] Appl. No.: 786,245

[22] Filed: Jan. 22, 1997

[51] Int. Cl.[6] ..... E02F 9/00

[52] U.S. Cl. ..... 414/724; 414/607; 414/608; 414/912; 37/406; 37/403

[58] Field of Search ..... 414/607, 608, 414/421, 422, 425, 724, 722, 912, 703; 37/403, 405, 406, 903

[56] References Cited

U.S. PATENT DOCUMENTS

| | | | |
|---|---|---|---|
| 3,348,715 | 10/1967 | Kretz | 414/607 X |
| 4,897,013 | 1/1990 | Thompson et al. | 414/703 |
| 4,915,575 | 4/1990 | Langenfeld et al. | 414/703 |

*Primary Examiner*—Donald W. Underwood
*Attorney, Agent, or Firm*—Lalos & Keegan

[57] ABSTRACT

A material handling system generally consisting of a base assembly including a support means mountable on the operating arms of a vehicle, an arm member pivotally connected to the support means and movable between open and closed positions relative to the support means for clamping an article mounted on the support means therebetween and means for displacing the clamping member between the open and closed positions; a material container assembly including a support means mountable on the support means of the base assembly, a container mounted on and pivotally connected to the support means of the material container assembly and engageable by the clamping arm member of the base member when the support means of the material container assembly is mounted on the support means of the base assembly; and means operatively interconnecting the clamping arm member of the base assembly and the container of the material container assembly when the material container assembly is mounted on the base assembly for effecting an angular displacement of the container relative to the support means thereof upon angular displacement of the clamping arm member between the open and closed positions thereof.

33 Claims, 3 Drawing Sheets

MATERIAL HANDLING SYSTEM

This invention relates to a material handling system and more particularly to a system which provides for accumulating a loose material in a container and readily elevating, transporting and tilting such container in handling or otherwise processing such material.

BACKGROUND OF THE INVENTION

In many commercial and industrial operations, it often is desirable to accumulate a loose material such as a useful material being processed or otherwise handled or a waste product being disposed, and then to transport or transfer such material to a storage facility, perhaps an inlet hopper of a processing facility, another transport vehicle such as a truck hauler or a railway car, or a landfill site. Usually, such containers are large, heavy and bulky, and require specially designed and complex equipment to elevate, transport and empty. Such equipment can involve substantial capital investment, difficult and burdensome operating requirements and comparatively high operating and maintenance costs. It thus has been found to be desirable to provide a system of the type described which requires a relatively low capital investment, is simple and easy to operate and has comparatively low operating and maintenance costs.

SUMMARY OF THE INVENTION

The present invention provides for a material handling system generally consisting of a base assembly detachably mountable on a vehicle and a material container assembly detachably mountable on such base assembly. The base assembly includes a support means mountable on the operating arms of a vehicle such as a front end loader, an arm member pivotally connected to the support means and movable between open and closed positions relative to the support means for clamping the base assembly mounted on the support means between the support means and the clamping arm and means for displacing the clamping arm member between the open and closed positions. The material container assembly includes support means mountable on the support means of the base assembly, a container supported on and pivotally connected to the support means of the container assembly and engageable by the clamping arm member of the base assembly when the material container assembly is mounted on the support means of the base assembly, and means operatively interconnecting the clamping arm member of the base assembly and the container of the material container assembly when the container assembly is mounted on the base assembly for effecting an angular displacement of the container relative to the support means of the container assembly upon angular displacement of the clamping arm member between its open and closed positions.

The means operatively interconnecting the clamping arm member and the container consists of a link which further may consist of a unitary member pivotally connected at its ends to the container and the clamping arm or an articulated link. The container portion of the container assembly includes an upwardly and forwardly formed opening through which material deposited in the container may be discharged when the container assembly is mounted on the base assembly, the container assembly on the base assembly is elevated and the clamping arm member of the base assembly is angularly displaced to tilt the container forwardly.

DESCRIPTION OF THE PREFERRED EMBODIMENTS OF THE INVENTION

Figure 1:
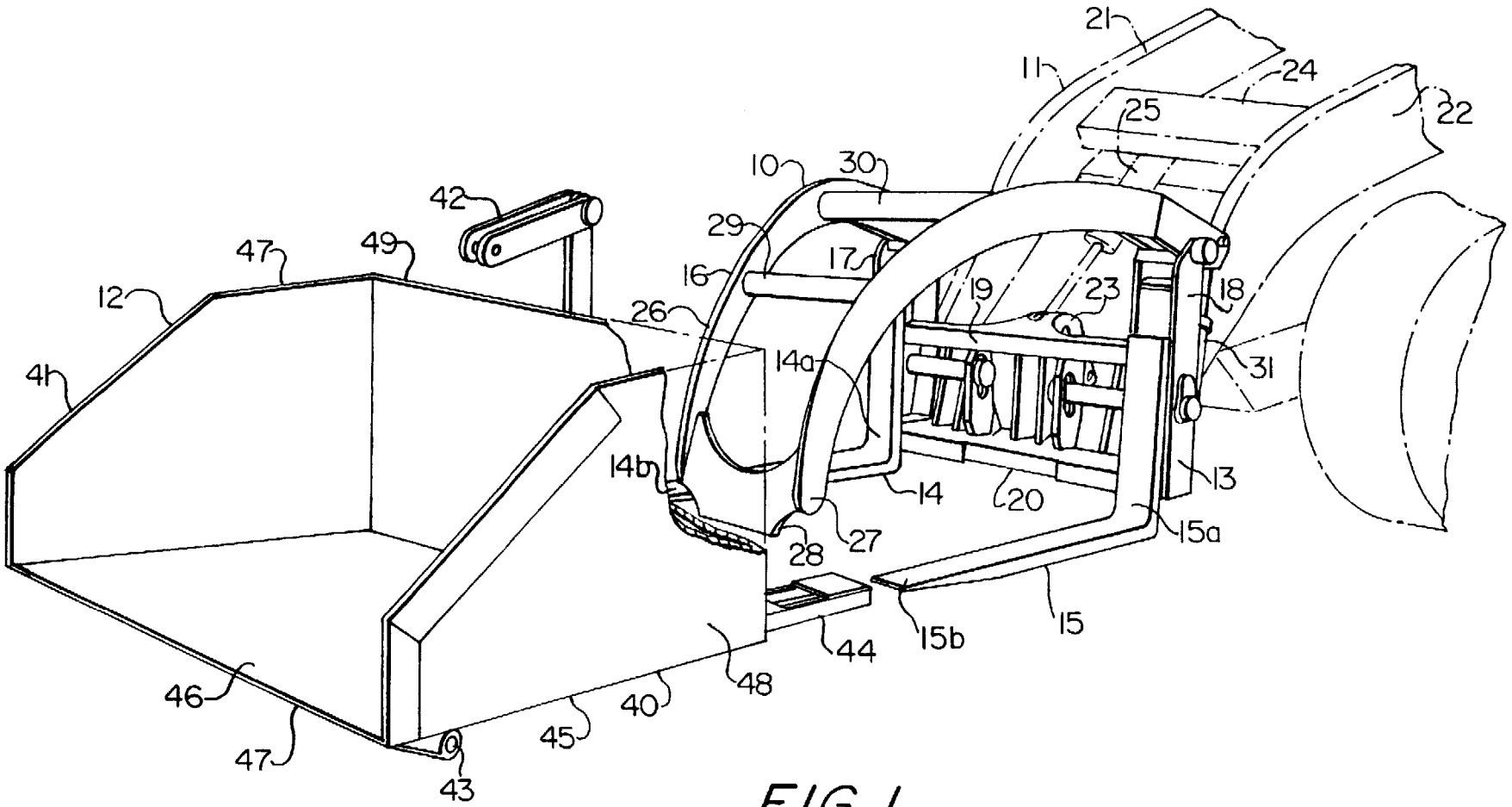
FIG. 1 is a perspective view of a first embodiment of the present invention, illustrating a base assembly thereof mounted on the operating arms of a vehicle and a material container assembly thereof detached from such base assembly.
Figure 3:
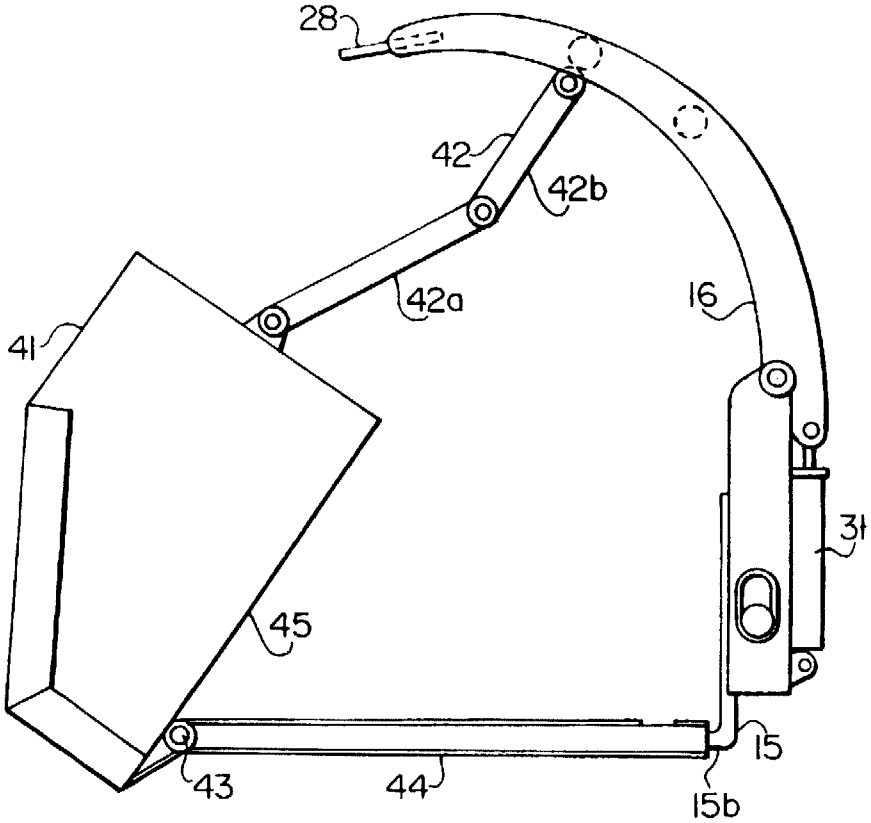
FIG. 3 is a view similar to the view shown in FIG. 2, illustrating the container portion of the container assembly being tilted for discharging the contents thereof.
Figure 2:
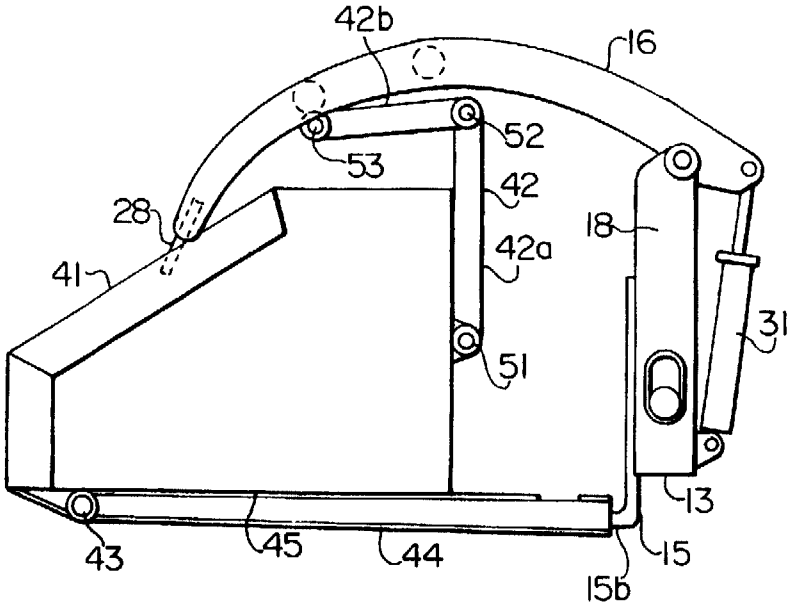
FIG. 2 is a side elevational view of the embodiment shown in FIG. 1, illustrating the material container assembly supported on the base assembly for transporting or transferring the container assembly.

Referring to FIGS. 1 through 3 of the drawings, there is shown a first embodiment of the invention which generally includes a base assembly 10 detachably mountable on a front end loader 11 and a material container assembly 12 detachably mountable on base assembly 10. Base assembly 10 essentially consists of a conventional grapple type of attachment and includes a frame 13, a pair of tines 14 and 15 and an arm member 16. The frame member includes a pair of transversely spaced, upright sections 17 and 18, and a pair of spaced, transversely disposed beam sections 19 and 20 rigidly connected at their ends to upright sections 17 and 18. The frame further is provided with a pair of mounting brackets on the rear side thereof for pivotal connection to the free ends of a pair of lift arms 21 and 22 of the front end loader, and a centrally disposed mounting bracket 23. Interconnecting mounting bracket 23 and a crossbeam member 24 interconnecting lift arms 21 and 22 is a hydraulic cylinder assembly 25 which is adapted to be operated by the operator of the front end loader to pivot the base assembly about the horizontal axis of the interconnection of the assembly with the lift arms. Typical of front end loaders, there is provided a set of hydraulic cylinder assemblies interconnecting the frame of the loader and lift arms 21 and 22 for lifting and lowering the base assembly in the conventional manner.

Tines 14 and 15 are provided with base sections **14*a* and 15*a*, respectively, which are rigidly secured to the front sides of upright members 17 and 18 of frame 13, and transversely spaced, forwardly projecting sections 14*b* and 15*b*** which are adapted to support the container assembly as will hereinafter be described.

Arm member 16 includes a pair of transversely spaced, arcuate converging arm sections 26 and 27 connected by means of a set of pins to the upper ends of upright frame sections 17 and 18, for pivotal movement about a transverse axis disposed substantially parallel to the axis of the pivotal connection of frame 13 to lift arms 21 and 22, a cross piece member 28 interconnecting the forward ends thereof and a set of intermediately disposed cross piece members 29 and 30. Arm sections 26 and 27 converge in a forward direction so that the free end of arm member 16 is adapted to be received between the forwardly disposed ends of tine sections **14*b* and 15*b*. Angular displacement of arm member 16 relative to tines 14 and 15 is provided by a pair of hydraulic cylinder assemblies 31, 31 operatively interconnecting brackets provided on the rear sides of upright frame sections 17 and 18, and rear end portions of arm sections 26 and 27**.

It will be appreciated that by lifting and lowering lift arms 21 and 22, base assembly 10 may be lifted and lowered, by operating cylinder assembly 25, the base assembly may be angularly displaced relative to the lift arms, and by operating cylinders 31, 31, arm member 16 may be pivoted relative to tines 14 and 15 to close and open and correspondingly clamp and release an article supported on tine support sections **14*b* and 15*b*. Being of an essentially conventional grapple type construction, base assembly 10** may be utilized not only as a component of the present invention but also as a conventional grapple.

Container assembly 12 is adapted to be supported on the base assembly and firmly secured between the tine members and clamping arm member 16, and generally consists of a support member 40 cooperable with tines 14 and 15 for mounting the container assembly on the base assembly, a container 41 pivotally connected at its front end to support member 40 for angular displacement relative thereto about a transverse axis and a link 42 connected to container 41 and connectable to arm member 16. Support member 40 includes a transversely disposed rod 43, a pair of transversely spaced, rearwardly projecting sleeve sections 44, 44 connected at their forwardly disposed ends to rod 43 and a support platform 45 disposed on and rigidly secured to sleeve sections 44, 44. The sleeve sections open rearwardly and are adapted to receive tine support sections **14*b* and 15*b* for supporting the container assembly on the base assembly with container 41 seated on support platform 45**.

Container 41 has a bottom wall surface 46 which is integral to support platform 45 having a hinge portion 47 cooperating with rod 43, a pair of side walls 47 and 48, and a rear wall 49. Support platform 45 seats container 41 on support member 40, and container 41 is adapted to be angularly displaced or tilted forwardly relative to support member 40 about the transverse axis of rod 43 by virtue of the pivotal connection between the front end of the container and rod 43 disposed at the front end of the support member. Container 41 opens upwardly and forwardly so that upon pivoting the container relative to the support member thereof about the axis of rod 43, loose material deposited therein will be caused to be discharged or dumped from the container.

The tilting or dumping movement of container 41 relative to support member 40 is affected by the pivotal movement of clamping arm member 16 when the container assembly is mounted on the base assembly and link 42 is operatively connected to clamping arm member 16. As best seen in FIGS. 2 and 3, link 42 includes a first section **42*a* pivotally connected at one end to a bracket 51 provided on the rear side of container wall section 49, and a section 42*b* pivotally connected at one end thereof to link section 42*a* as at 52 and pivotally connected at the other end thereof to a depending bracket on cross piece section 29 as at 53. It will be appreciated that when the container assembly is mounted on the base assembly, link 42 is operatively connected to arm member 16 and the rod sections of cylinder assemblies 31, 31 are extended, as shown in FIG. 2, the container assembly will be supported on the base assembly and securely clamped between clamping arm member 16 and tine support sections 14*b* and 15*b*, and when the container assembly is supported on the base assembly, link 42 is operably connected to arm member 16 and the rod portions of cylinder assemblies 31, 31 are retracted, as the clamping arm member pivots upwardly and rearwardly, container 41 will be caused to pivot or tilt forwardly about the axis of rod 43 to discharge or dump any material deposited in the container, as shown in FIG. 3**.

In the use of the system as described, one or more of the container assemblies may be situated at one or more locations and used to receive and accumulate loose material which is desired to be collected and transported to a different location or locations. The material deposited in the container or containers may consist of a useful product to be further handled or processed or may consist of a waste material to be disposed. Whenever one of such container assemblies has been filled and it is desired to transport the material to another location, such relocation can be achieved by a base assembly 10 mounted on a front end loader as described. The container assembly may be engaged, lifted and transported to another location and discharged simply by operating cylinder assemblies 31, 31 to pivot arm member 16 upwardly into an open position, aligning tine support sections **14*b* and 15*b* with the openings in sleeve sections 44, 44, advancing the loader forwardly so that tine support sections 14*b* and 15*b* are received within sleeve sections 44, 44, operating cylinders 31, 31 to pivot clamp arm member 16 downwardly to a lower, clamping position as shown in FIG. 2, connecting link 42** to the clamping arm member in the closed position and then operating the loader to lift and transport the container assembly to the desired destination.

By operating suitable controls on the loader, the lift arm cylinders and tilt cylinder 25 may be operated to lift the container assembly off the ground while maintaining it level so as not to spill any of the material in the container. Further controls on the loader can then be operated to transport the container assembly in such an elevated position to a location where the material in the container is to be deposited. If the material is to be discharged into an elevated truck bed, a railway car with high walls or an elevated hopper of a storage or processing facility, the lift arms on the loader may be operated to lift the container assembly to a sufficient height.

After the container assembly has been transported to the desired destination and the container has been positioned over the body which is to receive the material in the container, the operator on the loader may then operate suitable controls on the loader to cause the rod portions of cylinders 31, 31 to retract and thus cause arm member 16 to pivot upwardly and rearwardly into an open position as shown in FIG. 3. As the arm member pivots upwardly and rearwardly, link 42 will function to cause container 41 to pivot upwardly or tilt forwardly relative to the axis of rod 43 to correspondingly cause material deposited therein to discharge and gravity fall into the selected receptacle below. Whenever base assembly 10 is not being used to engage and transport a container assembly 12 as described, it may be used as a conventional grapple apparatus to grapple and transport other objects such as logs and the like in the conventional manner.

Figure 5:
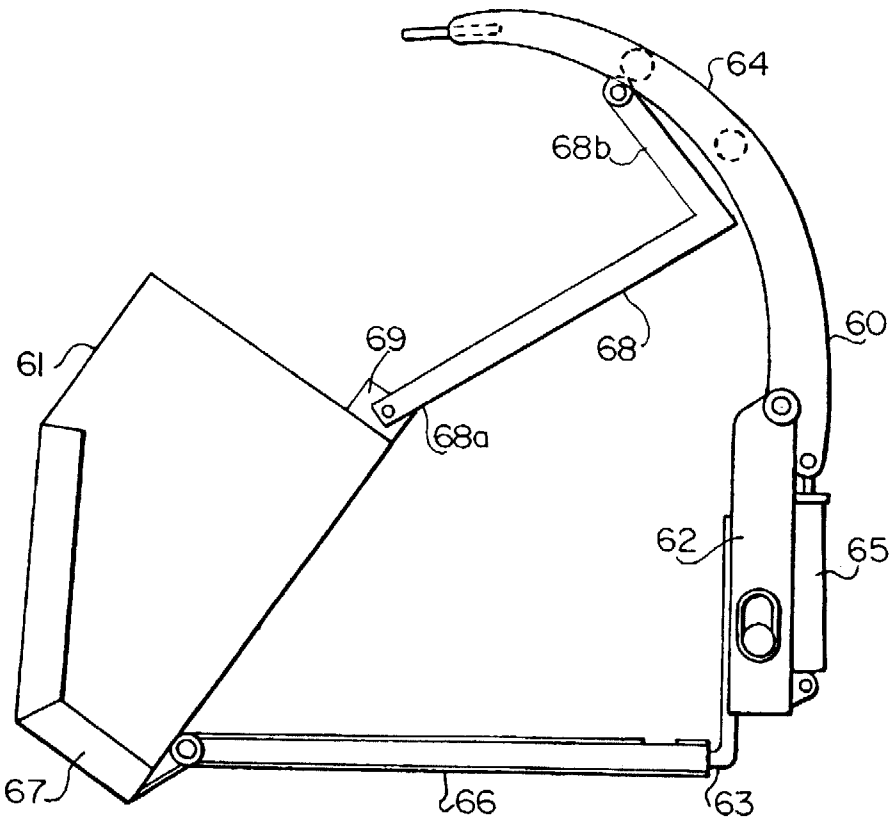
FIG. 5 is a view similar to the view shown in FIG. 4, illustrating the container of the container assembly being tilted for discharging the contents thereof.
Figure 4:
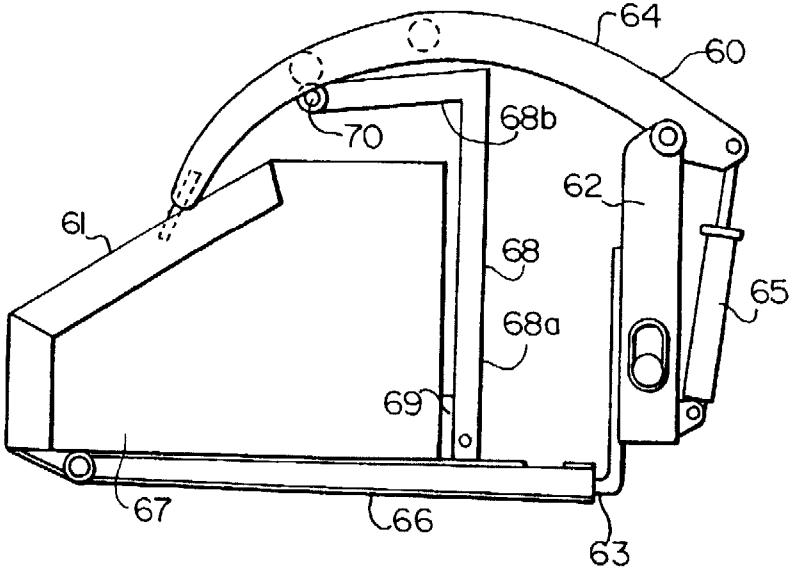
FIG. 4 is a view similar to the view shown in FIG. 2, consisting of a modification of the embodiment shown in FIGS. 1 through 3.

FIGS. 4 and 5 illustrate a modification of the embodiment of the invention shown in FIGS. 1 through 3. This second embodiment differs from the previously described embodiment only in terms of the construction of the link operatively interconnecting the container of the container assembly and the clamping arm member of the base assembly. The link in this second embodiment is of a unitary construction in lieu of being articulated as in the previously described embodiment. The embodiment shown in FIGS. 4 and 5 is constructed and operates similar to the construction and operation of the embodiment shown in FIGS. 1 through 3. Specifically, the embodiment of FIGS. 4 and 5 discloses a system consisting of a base assembly 60 mountable on the lift arms of a front end loader as shown in FIG. 1, and a container assembly 61 detachably mountable on base assembly 60. The base assembly includes a base member 62, a pair of tines 63, 63 and a clamping arm member 64 operated by a pair of hydraulically actuated cylinder assemblies 65, 65. The container assembly includes a support member 66 adapted to be supported on forwardly disposed sections of tines 63, 63, in the manner as previously described, a container 67 pivotally connected at its forward end to a forward end of support member 66 and a unitary link 68 connected to container 67 and connectable to clamping arm 64. Link 68 includes a section 68*a* pivotally connected to a bracket 69 provided on an outer, lower side of a rear wall of container 67, and an integral section 68*b* disposed at an angle to link section 68*a* and pivotally connectable to a cross piece section of clamping arm 64 as at 70.

As in the previously described embodiment, when the container assembly is mounted on the base assembly and the rod portions of cylinder assemblies 65, 65 are extended, the clamping arm member will be pivoted forwardly and downwardly to a closed position to clamp the container assembly between the clamping arm member and tine members 63, 63. Whenever the rod portions of cylinder assemblies 65, 65 are retracted, the clamping arm member will be caused to pivot upwardly and rearwardly into an open position, correspondingly causing link 68 to pivot container 67 upwardly and forwardly as shown in FIG. 5.

In applications where it may be required to elevate the container assembly to elevations beyond the capability of the lifting arms of the loader, base assemblies providing for displacement of the tine members relative to the base members thereof may be used as described and claimed in U.S. Pat. No. 5,518,359 which is incorporated herein by reference. In such a modification of the embodiments as described, whenever the lift arms of the loader have been elevated to their maximum height and additional elevation of the container assembly is required to clear a wall or other construction of a receptacle into which the material in the container is to be discharged, the operator would be able to operate other controls on the loader to cause the tine members on which the container assembly is supported to elevate the container assembly further to clear the wall or other obstacle.

In the use of the various embodiments of the invention as described, it will be appreciated that various types of loose material may be accumulated and transported as desired without the necessity of any specially designed or complex equipment requiring a substantial capital investment. Essentially, a conventional type of grappling apparatus mountable on a conventional free end loader may be used to engage, retain, elevate, transport and dump a container assembly of comparatively simple design, expeditiously and with comparatively little skill and effort. The system not only provides an efficient and effective means for accumulating and transporting loose materials but further provides a greater flexibility and utilization of equipment in allowing for the use of the base assembly, essentially consisting of a grapple apparatus, for other conventional grappling operations.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A material handling apparatus comprising:

support means mountable on operating arms of a vehicle;

material holding means supported on and pivotally connected to said support means, having a material discharge opening and being angularly displaceable about the axis of the pivotal connection thereof with said support means between a rest position on said support means and a dump position allowing material disposed therein to be gravity discharged through said material discharge opening;

clamping means operatively connected to said support means and displaceable between a first position when said material holding means is supported on said support means in said rest position for maintaining said material holding means between said clamping means and said support means, and a second position displaced from said material holding means;

means direct interconnecting said material holding means and said clamping means operable for angularly displacing said material holding means between said rest and dump positions upon said clamping means being displaced between said first and second positions; and means for displacing said clamping means between said first and second positions.

2. An apparatus according to claim 1 wherein said material holding means is provided with an upwardly and forwardly opening discharge opening.

3. An apparatus according to claim 1 wherein said clamping means comprises and arm member.

4. An apparatus according to claim 1 wherein said means operatively interconnecting said material holding means and said clamping means comprises a link.

5. An apparatus according to claim 4 wherein said link comprises articulated link.

6. An apparatus according to claim 1 wherein said means for displacing said clamping means comprises at least one hydraulically actuated cylinder assembly.

7. An apparatus according to claim 1 wherein said clamping means comprises an arm member pivotally connected to said support means, angularly displaceable between said first and second positions.

8. An apparatus according to claim 7 wherein the axes of the pivotal connection of said material holding means and said support means and of the pivotal connection of said clamping means and said support means, are parallel.

9. An apparatus according to claim 7 wherein said material holding means comprises a receptacle having an upwardly and forwardly opening discharge opening.

10. An apparatus according to claim 7 wherein said means operatively interconnecting said material holding means and said clamping arm comprises a link pivotally connected to said material holding means and said clamping arm.

11. An apparatus according to claim 10 wherein the axes of all of said pivotal connections are parallel.

12. An apparatus according to claim 10 wherein said link comprises an articulated link.

13. An apparatus according to claim 12 wherein the axes of all pivotal connections are parallel.

14. An apparatus according to claim 7 wherein said means for displacing said clamping arm member comprises at least one hydraulically actuated cylinder assembly.

15. An apparatus according to claim 1 wherein said material holding means includes means for detachably securing said material holding means to said support means.

16. A material handling system comprising:

a base assembly including a support means mountable on operating arms of a vehicle, an arm member pivotally connected to said support means and movable between open and closed positions relative to said support means for clamping an article mounted on said support means therebetween and means for displacing said clamping arm member between said open and closed positions;

a material container assembly including a support means mountable on said support means of said base assembly, a container mounted on and pivotally connected to said support means of said material container assembly and engageable by said clamping arm member when said support means of said material container assembly is mounted on said support means of said base assembly; and means directly interconnecting clamping said arm member and said container when said material container assembly is mounted on said base assembly for effecting an angular displacement of said container relative to said support means of said material container assembly upon angular displacement of said clamping arm member between said open and closed positions thereof.

17. A system according to claim 16 wherein said container is provided with an opening through which material disposed therein may be gravity discharged when said material container assembly is mounted on said base assembly and said clamping am member is angularly displaced.

18. A system according to claim 16 wherein said interconnecting means comprises a link.

19. A system according to claim 18 wherein said link comprises a unitary member having a first section pivotally connectable to said clamping arm member and a second section angularly displaced relative to said first section and pivotally connected to said container.

20. A system according to claim 18 wherein said link comprises an articulated link.

21. A system according to claim 16 wherein said means for displacing said clamping arm member relative to said support means of said base assembly comprises at least one hydraulically actuated cylinder assembly.

22. A system according to claim 16 wherein when said material container assembly is mounted on said base assembly, the axes of said pivotal connections are disposed substantially parallel.

23. A system according to claim 16 wherein said support means of said material container assembly includes at least one pocket and said support means of said base assembly includes a protruding portion receivable within said pocket for mounting said material container assembly on said base assembly.

24. A system according to claim 23 wherein said protruding portion of said support means of said base assembly is displaceable relative to a base portion thereof along a line of travel disposed at an angle to a line of travel of said protruding portion when being inserted into said pocket of said support means of said material container assembly.

25. A system according to claim 24 wherein said first mentioned line of travel is substantially vertical.

26. A system according to claim 16 wherein said support means of said material container assembly is provided with a pair of transversely spaced pockets, and said base assembly includes a pair of forwardly extending tines receivable within said pockets for supporting said material container assembly on said base assembly.

27. A system according to claim 26 wherein said tines are displaceable along a substantially vertically disposed line of travel relative to a base portion of said base assembly.

28. A material container assembly mountable on a base assembly including a support means mountable on operating arms of a vehicle, an arm member pivotally connected to said support means and movable between open and closed positions relative to said support means for clamping an article mounted on said support means between said clamping arm member and said support means and means for displacing said clamping arm member between said open and closed positions, comprising:

support means mountable on said support means of said base assembly;

material holding means mounted on and pivotally connected to said support means thereof, engageable in clamping relation by said arm member of said base assembly when said support means thereof is mounted on said support means of said base assembly; and means directly interconnectable between said arm member of said base assembly and said material holding means when said support means thereof is mounted on said support means of said base assembly, for effecting an angular displacement of said material holding means relative to said support means thereof upon angular displacement of said arm member between said open and closed positions.

29. A material container assembly according to claim 28 wherein said means for effecting an angular displacement of said material holding means comprises a link.

30. A material container assembly according to claim 29 wherein said link comprises an articulated link.

31. A material container assembly according to claim 28 wherein said material holding means comprises a receptacle having an upwardly and forwardly opening discharge opening.

32. A material container system according to claim 28 wherein said support means thereof includes at least one pocket for receiving a protruding portion of said base assembly for mounting said material container assembly on said base assembly.

33. A material container assembly according to claim 28 wherein said support means thereof is provided with a pair of transversely spaced pockets for receiving a pair of forwardly extending tines of said base assembly for mounting said material container assembly on said base assembly.

* * * * *